US009512719B2

(12) United States Patent
Jonsrud et al.

(10) Patent No.: US 9,512,719 B2
(45) Date of Patent: Dec. 6, 2016

(54) CUTTING TOOL HOLDER EXTRACTION DEVICE

(71) Applicants: Jeremiah L. Jonsrud, Saint Paul, VA (US); Eric Paul Helsel, New Enterprise, PA (US)

(72) Inventors: Jeremiah L. Jonsrud, Saint Paul, VA (US); Eric Paul Helsel, New Enterprise, PA (US)

(73) Assignee: KENNAMETAL INC., Latrobe, PA (US)

( * ) Notice: Subject to any disclaimer, the term of this patent is extended or adjusted under 35 U.S.C. 154(b) by 47 days.

(21) Appl. No.: 14/600,331

(22) Filed: Jan. 20, 2015

(65) Prior Publication Data

US 2015/0128395 A1 May 14, 2015

(51) Int. Cl.
*E21C 35/18* (2006.01)
*E21C 35/193* (2006.01)

(52) U.S. Cl.
CPC ..... *E21C 35/193* (2013.01); *E21C 2035/1826* (2013.01); *Y10T 29/5383* (2015.01); *Y10T 29/53848* (2015.01)

(58) Field of Classification Search
CPC ..... E21C 2035/1826
See application file for complete search history.

(56) References Cited

U.S. PATENT DOCUMENTS

| | | | | |
|---|---|---|---|---|
| 5,249,342 | A * | 10/1993 | Smith | B23P 19/025 29/252 |
| 6,176,552 | B1 | 1/2001 | Topka, Jr. et al. | |
| 6,244,665 | B1 | 6/2001 | Bise et al. | |
| 6,526,641 | B1 * | 3/2003 | Latham | B25B 27/026 254/18 |
| 7,891,084 | B1 | 2/2011 | Sollami | |
| 8,099,847 | B2 * | 1/2012 | Hahn | E21C 35/197 29/239 |
| 2007/0045599 | A1 | 3/2007 | Bilyeu et al. | |
| 2016/0076371 | A1 * | 3/2016 | O'Neill | E21C 35/197 299/10 |

* cited by examiner

*Primary Examiner* — John Kreck
(74) *Attorney, Agent, or Firm* — Matthew S. Bedsole

(57) ABSTRACT

A cutting tool holder extraction devise comprising a cup, having a back portion having a rearward socket and a front portion having a forward tool socket, and a spacer section having an axial bore with a back orifice opening in the bottom of the rearward socket and a front orifice opening in the bottom of the tool socket; an expandable jack, the jack having an axial bore, and a front face; the front face of the jack is removably engageable with the rearward socket of the cup; a threaded bolt, the bolt having a front end and a rear end, the bolt removably disposable through the cup bore and through the jack bore; and at least one nut, removably attachable to the threaded bolt.

12 Claims, 7 Drawing Sheets

CUTTING TOOL HOLDER EXTRACTION DEVICE

BACKGROUND OF THE INVENTION

The invention pertains to a cutting tool holder extraction device that is useful in association with machines for impinging a substrate or earth strata such as, for example, asphaltic roadway material, coal deposits, mineral formations and the like. More particularly, the invention pertains to a cutting tool holder extraction device, as well as to the individual components of the device.

One typically uses such a device in conjunction with a rotatable drum or driven member. The driven member rotates in such a fashion to drive the rotatable cutting bit or tool into earth strata to disintegrate the same into smaller pieces including fine particulates, i.e., cutting debris. The cutting bit or tool, the tool holder and the base are each subjected to considerable stresses during mining operations, road milling operations or other like operations that can lead to wear and/or failure of one or more of the cutting tool assembly components. The tool and tool holder in particular must be changed periodically to replace worn or damaged units. Worn tool holders are particularly difficult to remove from a base, and care must be taken to prevent damage from occurring to the base when removing worn or damaged holders. If the sleeve is not removed from the base in the direction of the base bore, the removal of the sleeve can damage the base bore necessitating replacement of the base as well as the tool holder.

Accordingly, there is a need for a cutting tool holder extraction device that extracts a tool holder from a base while minimizing damage to the base during the holder extraction operation.

SUMMARY OF THE INVENTION

In accordance with an aspect of the invention, a cutting tool holder extraction devise comprising a cup, having a back portion having a rearward socket and a front portion having a forward tool socket, and a spacer section having an axial bore with a back orifice opening in the bottom of the rearward socket and a front orifice opening in the bottom of the tool socket; an expandable jack, the jack having an axial bore, and a front face; the front face of the jack is removably engageable with the rearward socket of the cup; a threaded bolt, the bolt having a front end and a rear end, the bolt removably disposable through the cup bore and through the jack bore; and at least one nut, removably attachable to the threaded bolt.

These and other aspects of the present invention will be more fully understood following a review of this specification and drawings.

DETAILED DESCRIPTION

The following description is for purposes of illustrating various aspects of the invention only and not for purposes of limiting the scope of the invention.

Referring to the Figures, there is illustrated a cutting tool holder extraction device, generally designated as reference number 10, in accordance with various aspects of the invention. It will be appreciated that the invention has application to various kinds of tool holder extraction. Exemplary operations include extraction of holders from bases, that without limitation include, road planing (or milling), coal mining, concrete cutting, and other kinds of cutting tool assemblies wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting tool holder extraction device 10 of the invention may be manufactured in various sizes and dimensions depending upon the desired application of the assembly.

Figure 13:
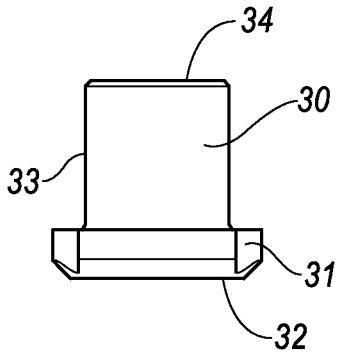
FIG. 13 is a side view of a tool holder.

Referring to the FIGS. 1, 2, 3 and 6 there is illustrated representative cutting tool base and holder assemblies. Base 25 is fixably attached to the surface of a rotatable drum (not shown). Base 25 has a front face 27 and a back face 28 and a bore 26 extending from said front face 27 to said back face 28. A tool holder 30 is removably disposed in the bore 26 of base 25. Each tool holder 30 has a head portion 31 having a forward face 32, a rearwardly extending shank 33, a rear face 34, and an axial bore 35 extending through said tool holder head portion 31 and shank 33, from said forward face 32 to said rear face 34 (FIG. 13). Cutting tools (not shown) are removably attachable to tool holder 30 within the tool holder bore 35. The shank 33 of tool holder 30 is removably disposable within base bore 26 and is held in place by a press fit and/or a detachable retainer (not shown in the figures). The tight fit between the tool holder shank 33 and the base bore 26 and the dust and particulates that infiltrate any gaps between the tool holder shank 33 and the base bore 26 during operation of the cutting tool assembly results in a secure attachment of the holder shank 33 within the base bore 26.

Referring to FIGS. 4-9, there is illustrated in detail the cutting tool holder extraction device 10 of the invention. The cutting tool holder extraction device 10 is adapted for removing a tightly engaged tool holder from the bore of a base block in a cutting tool assembly. Cutting tool holder extraction device 10 is comprised of a tool cup 11, a jack 40, a bolt 50 and at least one threaded nut 60.

Figure 9:
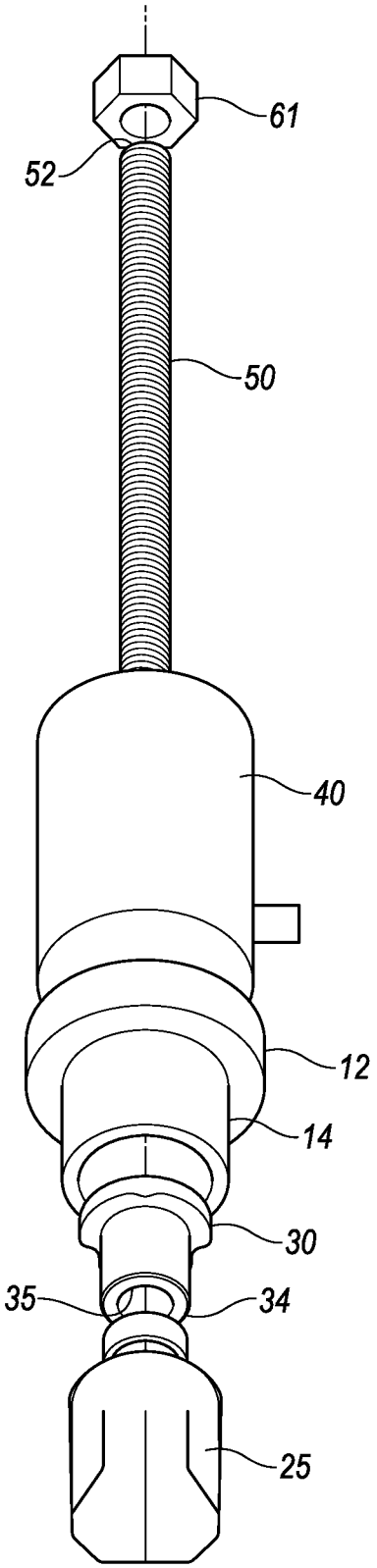
FIG. 9 is an exploded top view of the cutting tool holder extraction device in accordance with an aspect of the invention, and a base and a cutting tool holder.
Figure 10:
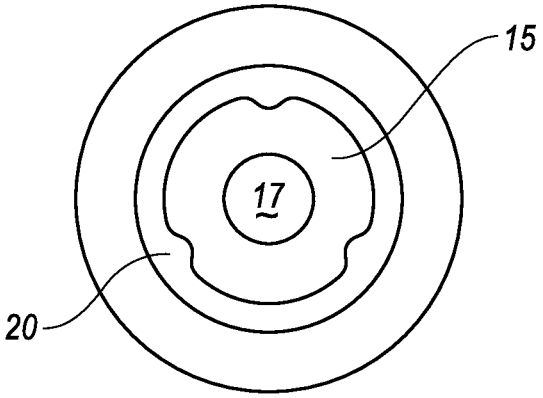
FIG. 10 is a top view of a cup portion of the cutting tool holder extraction device in accordance with an aspect of the invention.
Figure 12:
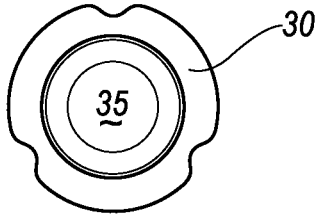
FIG. 12 is a top view of a tool holder.
Figure 11:
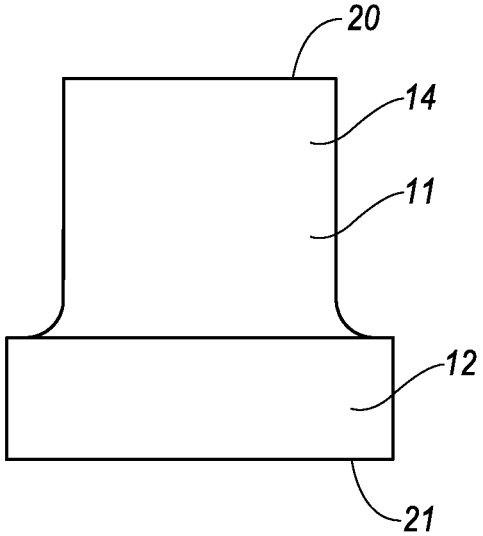
FIG. 11 is a side view of a cup portion of the cutting tool holder extraction device in accordance with an aspect of the invention.

Tool cup 11 is comprised of a back portion 12 having a jack socket 13 and a front portion 14 having a tool socket 15 and a spacer section 16 having an axial bore 17 with an back orifice 18 opening in the bottom of the jack socket 13 and a front orifice 19 opening in the bottom of the tool socket 15. Tool socket 15 terminates at forward face 20. Jack socket 13 terminates at rearward face 21. Cup 11 is attachable at jack socket 13 to a jack 40 capable of expanding and contracting. The tool socket 15 of cup 11 is keyed in a shape that corresponds to the shape of the head portion 31 of a tool holder as shown in FIGS. 9, 10 and 12. In the preferred embodiment the tool holder head 31 is shaped to expose a portion of the base front face 27, however any exposed portion of the base 25 frontal area would suffice to enable tool holder removal from base 25.

Figure 1:
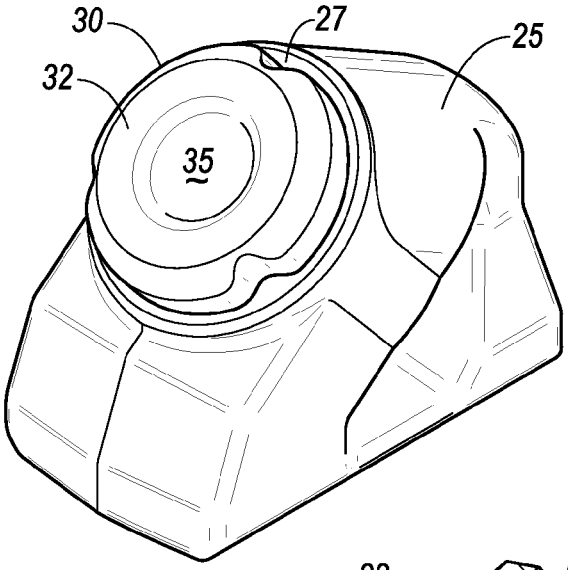
FIG. 1 is a perspective view of a base and a cutting tool holder.
Figure 2:
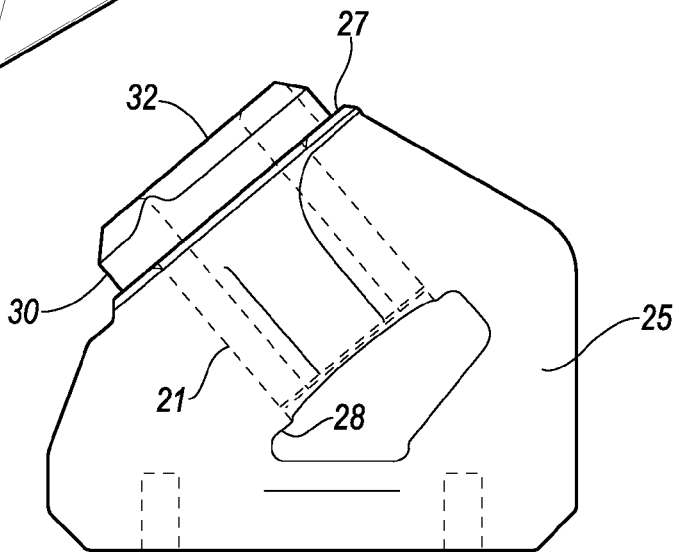
FIG. 2 is a side view of a base and a cutting tool holder.
Figure 3:
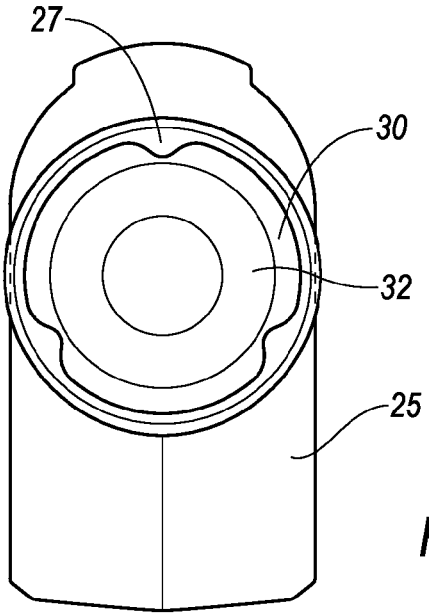
FIG. 3 is a front view of a base and a cutting tool holder.
Figure 4:
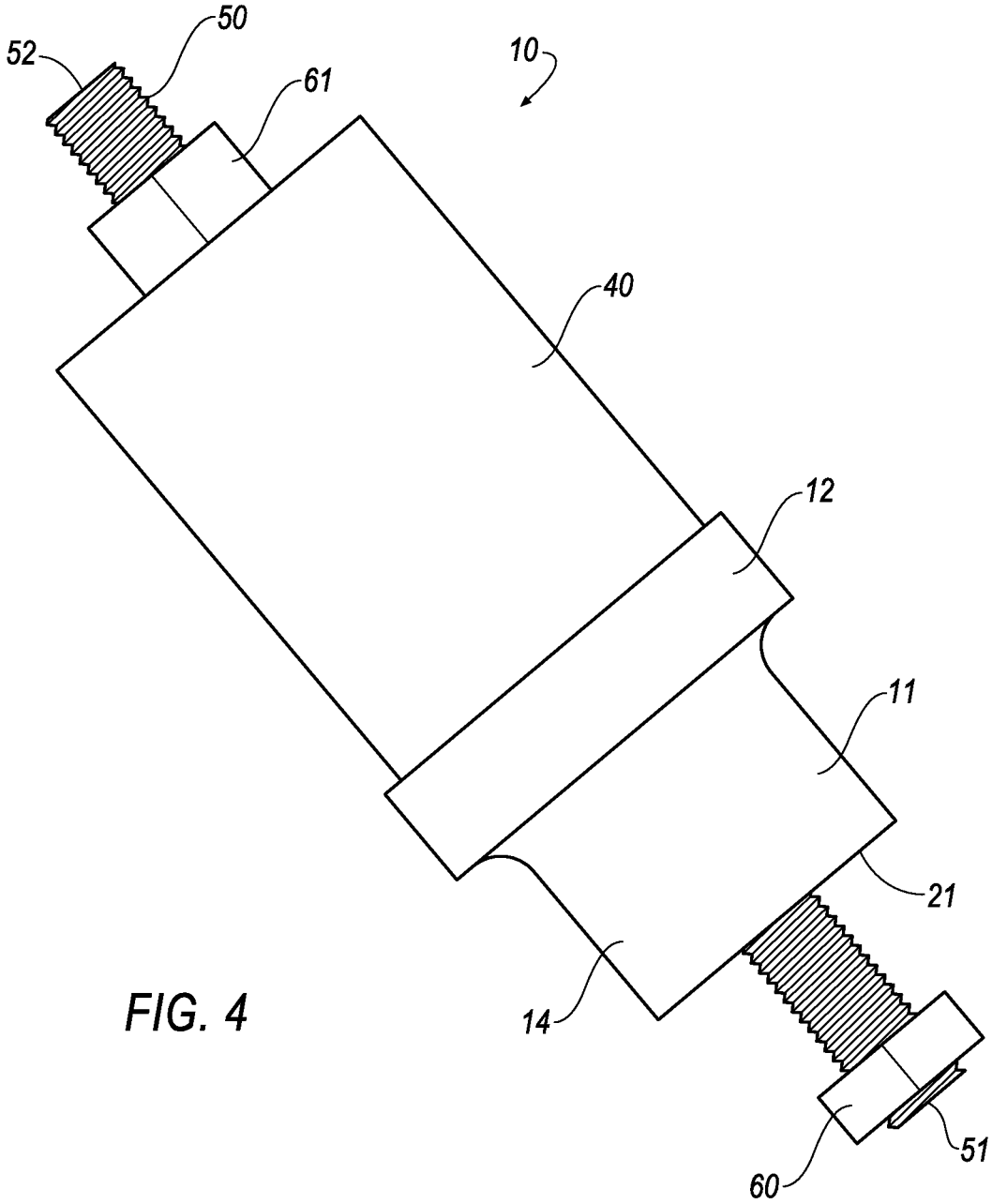
FIG. 4 is a side view of the cutting tool holder extraction device as assembled, in accordance with an aspect of the invention.
Figure 6:
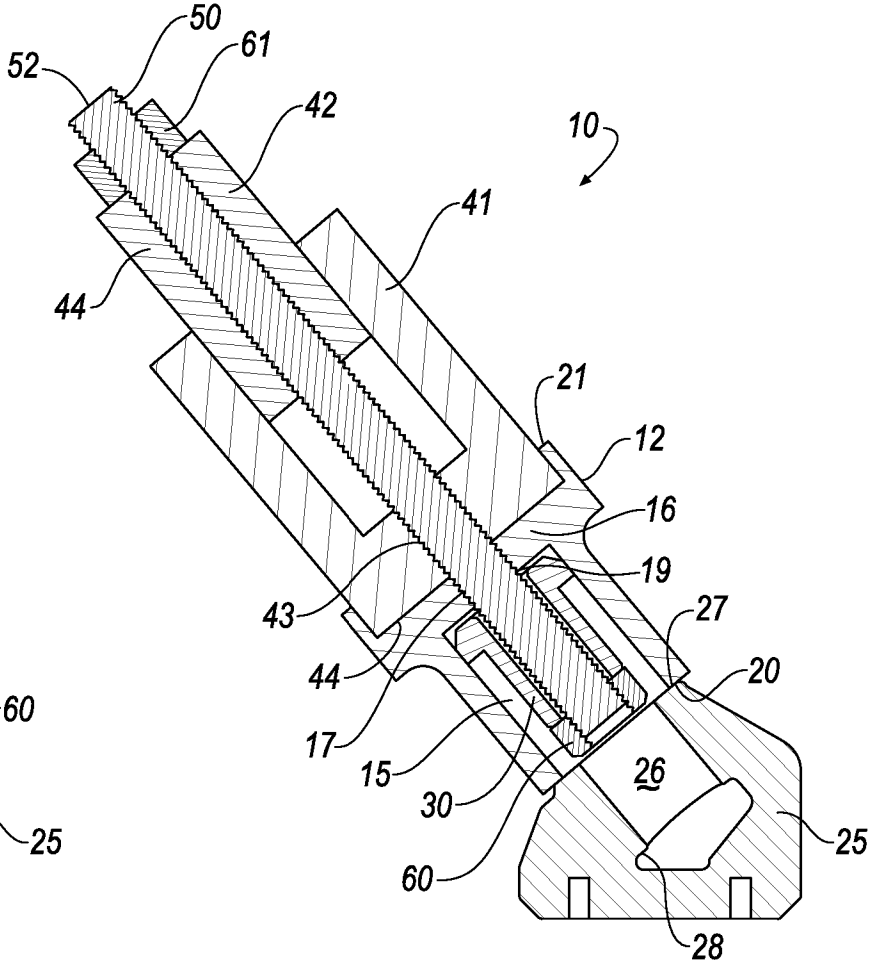
FIG. 6 is a cross sectional view of the cutting tool holder extraction device in accordance with an aspect of the invention, attached to a base and a cutting tool holder, after removal of the holder.
Figure 5:
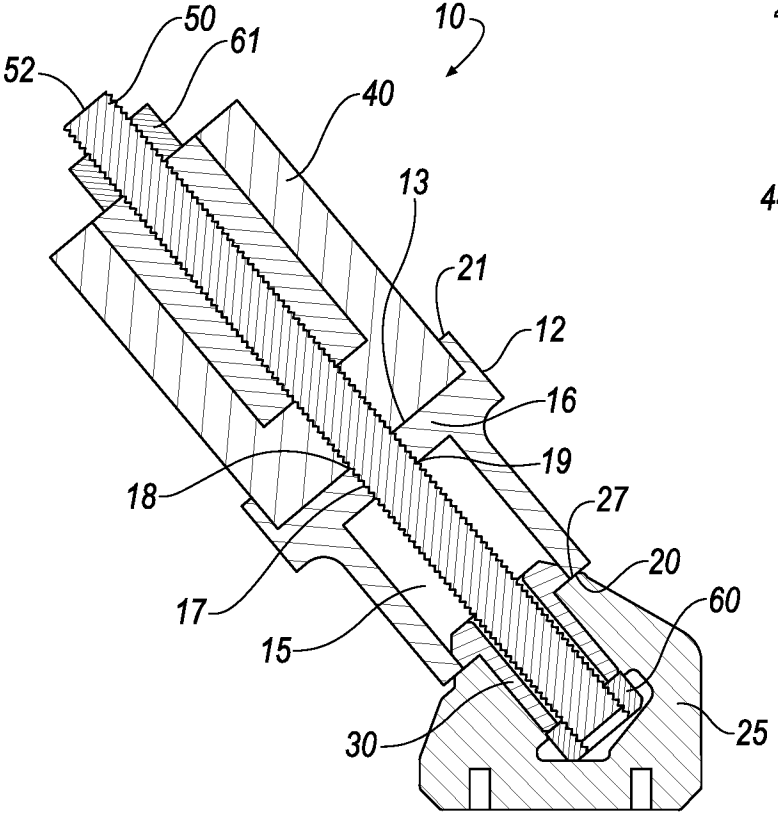
FIG. 5 is a cross sectional view of the cutting tool holder extraction device in accordance with an aspect of the invention, attached to a base and a cutting tool holder before removal of the holder.
Figure 7:
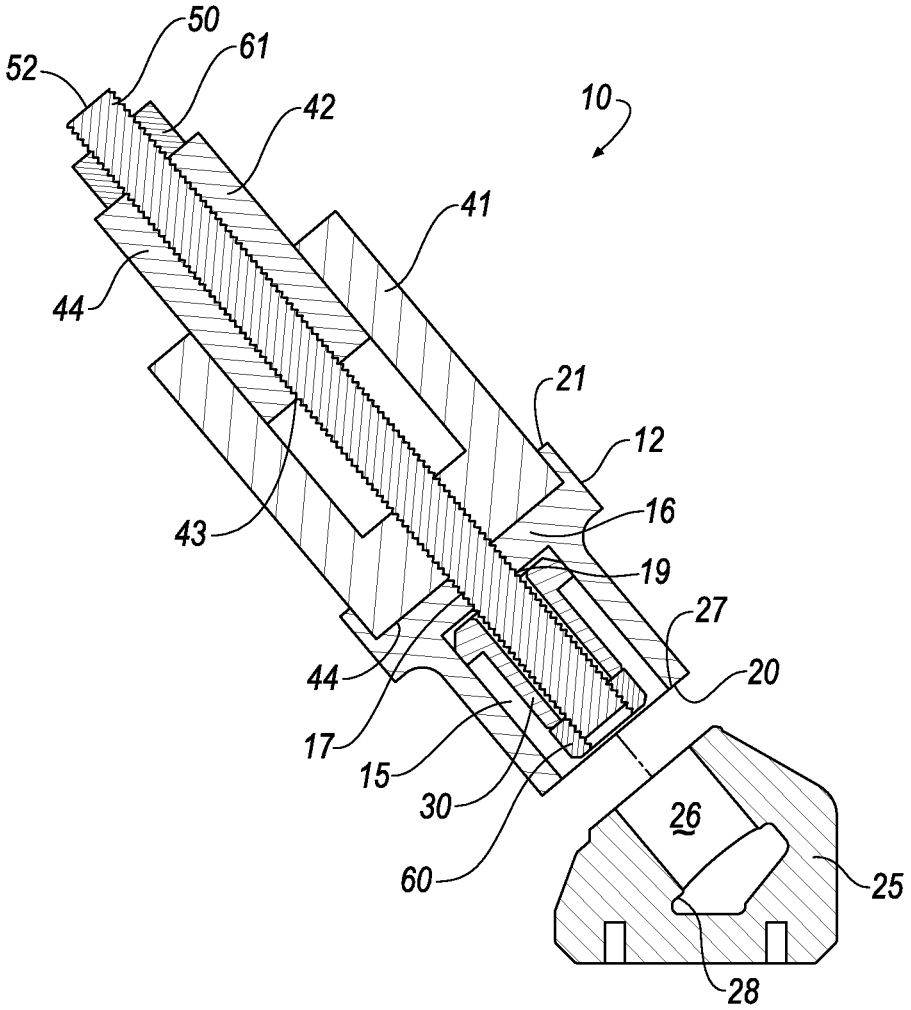
FIG. 7 is a cross sectional view of the cutting tool holder extraction device in accordance with an aspect of the invention, attached to a base and a cutting tool holder, after removal of the holder
Figure 8:
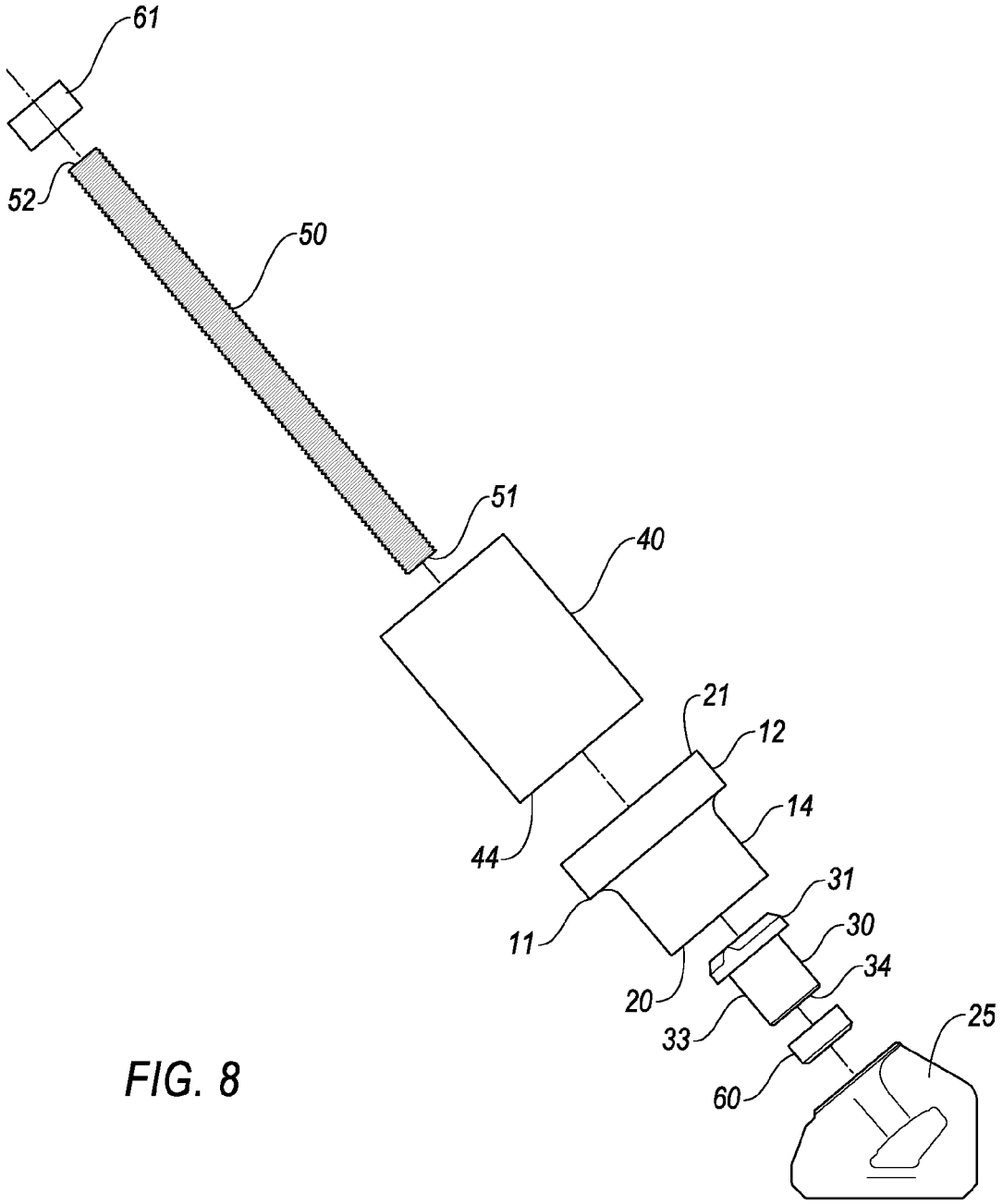
FIG. 8 is an exploded side view of the cutting tool holder extraction device in accordance with an aspect of the invention, and a base and a cutting tool holder.

In the preferred embodiment as shown in FIGS. 5, 6 and 7, jack 40 has at least two concentric sleeves, 41 and 42 that expand and contract axially, and an axial bore 43 extending through both sleeves 41 and 42. Jack 40 may be any expandable device capable of expanding and contracting against loads of 20 tons or greater. Preferred jacks are hydraulic cylinders. Particularly preferred jacks are hydraulic cylinders having a longitudinal bore capable of removably receiving a bolt 50.

Bolt 50 is a threaded bolt having a front end 51 and a back end 52. Threaded nut 60 is removably attachable to bolt 50 at front end 51 and a second nut 61 is removably attached to threaded bolt 50 at back end 52. In another embodiment (not shown), bolt 50 may have a fixed head at one end and threads for engaging a nut at the opposite end.

In operation, cup 11 is placed over the head portion 31 of tool holder 30 and positioned with cup forward face 20 adjacent base block front face 27. Nut 61 is threaded onto end 52 of bolt 50. Bolt 50 is inserted through the axial bore 35 of tool holder 30 until the front end 51 of bolt 50 extends beyond rear face 34 of tool holder 30. Nut 60 is threaded onto bolt 50 at engagement end 51 as shown in FIG. 5. A washer (not shown) may optionally be placed on front end 51 between rear face 34 and nut 60. Nut 61 can optionally be replaced by a fixed bolt head. When jack 30 is activated, cylinder face 44 pushes against the bottom of cup jack socket 13, and socket front face 20 pushes against the base front face 27. Nut 60 attached to bolt 50 applies pressure on the rear face 34 of tool holder 30 in the direction of the jack 40 along the axis of bolt 50. Simultaneously the cup front face 20 positioned against base block front face 27 inhibits movement of the cup 11 in relation to base 25. As jack 40 expands, sleeve 11 is pulled from bore 26 of base 25 and into socket 13 of cup 11 as shown in FIG. 6.

As shown in FIGS. 6 and 7, cup 11 must be of sufficient depth to completely encompass tool holder 30 without tool holder 30 impacting the bottom of the socket 13 to achieve compete removal from base block bore 26. In a preferred embodiment of the invention, socket 13 is shaped to correspond to the shape of the tool holder head portion 31. Mating the shape of socket 13 to tool holder head portion 31 inhibits lateral movement and rotation of tool holder 20 during extraction, thereby minimizing damage to the base bore 102.

Whereas particular aspects of this invention have been described above for purposes of illustration, it will be evident to those skilled in the art that numerous variations of the details of the present invention may be made without departing from the invention as defined in the appended claims. For example, various shapes, sizes or configurations of tool cups, jacks, bolts and threaded nuts are within the scope of this invention as defined in the appended claims.

What is claimed is:

1. A device for extracting a cutting tool holder from a base block, the cutting tool holder having a tool head, the device comprising:

a cup having a back portion having a rearward socket a front portion having a forward socket; and a spacer section having an axial bore extending from a back orifice in the bottom of the rearward socket to a front orifice in the bottom of the forward socket;

an expandable jack having an axial bore and a front face, the front face being removably engagable with the rearward socket of the cup;

a threaded bolt having a front end and a rear end, the threaded bolt being removably disposable through the axial bore of the cup and through the axial bore of the expandable jack; and at least a first nut and a second nut, the first nut being removably attachable to the threaded bolt at the front end, and the second nut being removably attachable to the threaded bolt at the rear end when the threaded bolt is disposed through the axial bore of the cup and through the axial bore of the expandable jack such that the first nut is forward of the forward socket of the cup and the second nut is rearward of the expandable jack.

2. The device of claim 1, wherein the expandable jack is a hydraulic cylinder.

3. The device of claim 1, wherein:

the tool head of the cutting tool holder defines a tool head shape;

the cup forward socket defines a socket shape; and the socket shape is complementary to the tool head shape.

4. A device for extracting a tool holder from engagement with a base block mounted on a rotatable drum, wherein the tool holder has a head portion, the tool holder having a forward face, a rearwardly extending shank, a rear face, and an axial bore extending through the head portion of the tool holder and the shank from the forward face to the rear face, and the base block having a body, the body having a front face and a back face and a bore extending from the front face to the back face, the tool holder shank being tightly fitted within the base block bore, the device comprising:

a) a cup having a front face defining a front socket a rear face defining a rear socket and a spacer portion separating the front socket and the rear socket, the spacer portion having a bore, the bore extending from a rear orifice in the rear socket to a front orifice in the front socket;

b) an expandable device attached to the cup rear face, the expandable device having an axial bore extending therethrough;

c) a threaded bolt having a front end and a rear end, the threaded bolt being removably disposable within the axial bore extending through the expandable device;

d) a first nut removably attachable to the threaded bolt at the front end of the threaded bolt; and e) a second nut removably attachable to the threaded bolt at the rear end of the threaded bolt;

wherein the head portion of the tool holder defines a tool head shape;

wherein the cup front socket defines a socket shape, the socket shape being complementary to the tool head shape;

wherein the cup face is configured to contact the base front face;

wherein the threaded bolt is removably disposable through the tool holder axial bore;

wherein the front end of the threaded bolt is extendible from the tool holder rear face; and wherein the first nut is attachable to the threaded bolt front end adjacent to the tool holder rear face and the second nut is attachable to the threaded bolt rear end rearward of the expandable device.

5. The device of claim 3, wherein:

the tool head shape includes a plurality of notches along a periphery of the tool head; and the socket shape includes a plurality of projections sized, shaped, and located to fit within the plurality of notches along the periphery of the tool head.

6. The device of claim 3, wherein the forward socket of the cup has an axial length greater than or equal to an axial length of the cutting tool holder.

7. The device of claim 4, wherein the tool head shape defines a plurality of notches along a periphery of the tool head; and the socket shape defines a plurality of projections sized, shaped, and located to fit within the plurality of notches along the periphery of the tool head.

8. The device of claim 4, wherein the forward socket of the cup has an axial length greater than or equal to an axial length of the cutting tool holder.

9. A method of extracting a cutting tool holder from a base block, the base block having a body, the body having a front face, a back face, and a bore extending from the front face of the body to the back face of the body, the tool holder being disposed within the bore of the body of the base block, the tool holder having a tool head, a forward face disposed on the tool head, a rearwardly extending shank, a rear face disposed on the rearwardly extending shank, and an axial bore extending through the tool head and the rearwardly extending shank from the forward face to the rear face, the method comprising:

providing an extraction device, the extraction device comprising:

a cup having a back portion having a rearward socket, a front portion having a forward face and a forward socket, and a spacer section having an axial bore extending from a back orifice in the bottom of the rearward socket to a front orifice in the bottom of the forward socket;

an expandable jack having an axial bore, a front face removably engagable with the rearward socket of the cup, and a rear face opposite the front face;

a threaded bolt having a front end and a rear end, the threaded bolt being removably disposable through the axial bore of the cup and through the axial bore of the expandable jack; and at least a first nut and a second nut, the first nut being removably attachable to the threaded bolt at the front end, and the second nut being removably attachable to the threaded bolt at the rear end;

placing the cup over the tool head of the tool holder to place the forward face of the front portion in contact with the front face of the body;

engaging the front face of the expandable jack with the rearward face of the cup;

disposing the threaded bolt through the axial bore of the cup, through the axial bore of the expandable jack, and through the axial bore of the cutting tool holder so that the front end of the threaded bolt is adjacent the rear end of the cutting tool holder and the rear end of the threaded bolt is adjacent the rear face of the expandable jack;

removably attaching the first nut to the threaded bolt at the front end of the threaded bolt and the second nut to the threaded bolt at the rear end of the threaded bolt; and expanding the expandable jack to extract the cutting tool holder from the bore of the base block by applying force in a first direction against the front face of the base block body with the forward face of the cup and applying force in a second direction opposite the first direction against the rear face of the cutting tool holder.

10. The method of claim 9, wherein:

the forward socket of the cup defines a socket shape;

the tool head of the cutting tool holder defines a tool head shape; and the socket shape is complementary to the tool head shape.

11. The method of claim 10, wherein:

the tool head shape defines a plurality of notches along a periphery of the tool head; and the socket shape defines a plurality of projections sized, shaped, and located to fit within the plurality of notches along the periphery of the tool head.

12. The method of claim 9, wherein the forward socket of the cup has an axial length greater than or equal to an axial length of the cutting tool holder.

* * * * *